US005741112A

United States Patent [19]

Lakin et al.

[11] Patent Number: 5,741,112

[45] Date of Patent: Apr. 21, 1998

[54] FLOOR AND BUCKET PROTECTION DEVICE

[75] Inventors: Lewis G. Lakin; Gilbert M. Younger, both of Northfield; Kurt Kenner, Wayne, all of Ill.

[73] Assignee: Lakin General Corporation, Ill.

[21] Appl. No.: 584,251

[22] Filed: Jan. 11, 1996

[51] Int. Cl.[6] ..... E02F 3/14

[52] U.S. Cl. ..... 414/722; 37/264; 172/772.5; 198/522

[58] Field of Search ..... 414/685, 722, 414/724; 294/56; 172/719, 772, 772.5; 37/411, 445, 446, 451, 453, 460, 264, 266; 198/522

[56] References Cited

U.S. PATENT DOCUMENTS

| | | | |
|---|---|---|---|
| 520,479 | 5/1894 | Bunnell . | |
| 634,578 | 10/1899 | Kaucher . | |
| 1,867,186 | 7/1932 | Soule et al. . | |
| 2,416,123 | 2/1947 | Siemen . | |
| 2,416,124 | 2/1947 | Siemen . | |
| 3,112,024 | 11/1963 | Lakin . | |
| 3,137,919 | 6/1964 | Lakin . | |
| 3,443,300 | 5/1969 | Lakin . | |
| 4,052,802 | 10/1977 | Moen | 37/460 |
| 4,141,160 | 2/1979 | Olson . | |
| 4,347,677 | 9/1982 | Kuper . | |
| 4,570,366 | 2/1986 | Yost . | |
| 4,819,349 | 4/1989 | Mensch . | |
| 5,012,599 | 5/1991 | DeClair et al. . | |
| 5,075,985 | 12/1991 | Mensch . | |
| 5,471,770 | 12/1995 | Ferreira . | |

OTHER PUBLICATIONS

"Earthmovers Make Practically Anything," Scrap Tire News, Oct., 1994, pp. 1, 3.

Ad for "Rubberized Wear Pads," F&B Enterprises, Inc., undated, 2 pages.

*Primary Examiner*—Donald W. Underwood

*Attorney, Agent, or Firm*—Bell Boyd & Lloyd

[57] ABSTRACT

A floor and bucket protection device and method of making the device, which includes a steel frame attachable to a bucket on a front end loader, a plurality of steel-reinforced rubber pads laminated on a steel frame between fiber-reinforced end pads, whereby the steel-reinforcing rubber pads include steel strands that strengthen the rubber pads thereby reducing the rate of wear of the pads and preventing tearing and chunking of the pads. The steel-reinforced rubber pads are die-cut from passenger and light-truck recycled steel-belted tires and the individual steel strands are adapted to extend from the pads along the wear surface engaging the ground as the rubber pads wear down and provide a sweeping and cleaning action along the floor.

11 Claims, 3 Drawing Sheets

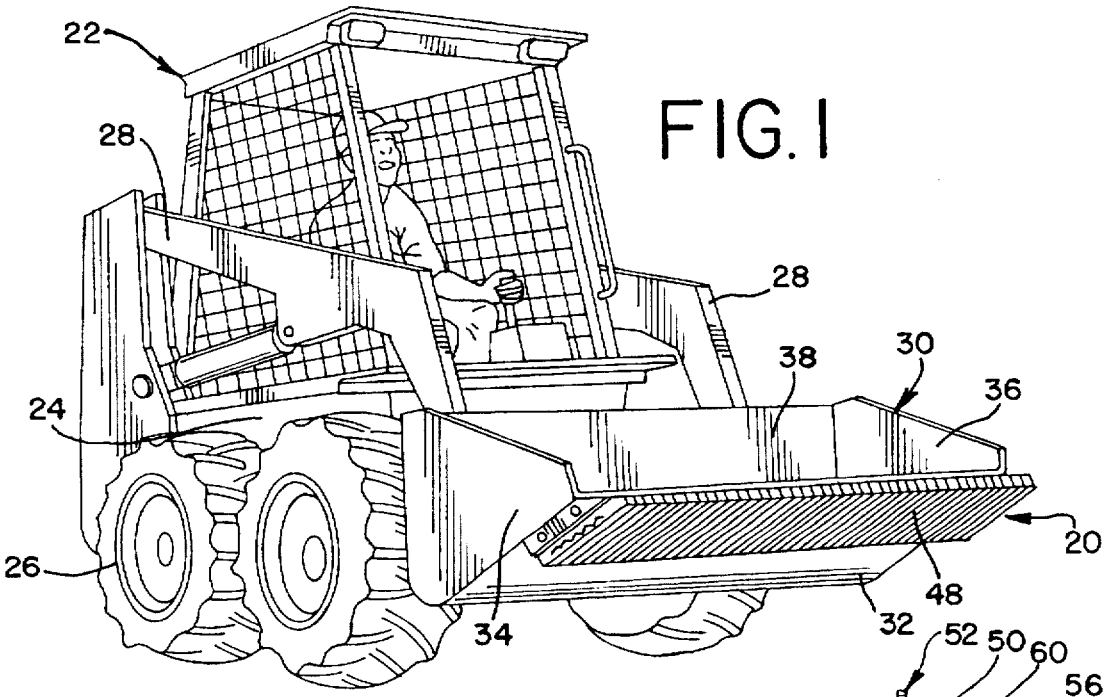
FIG. 1
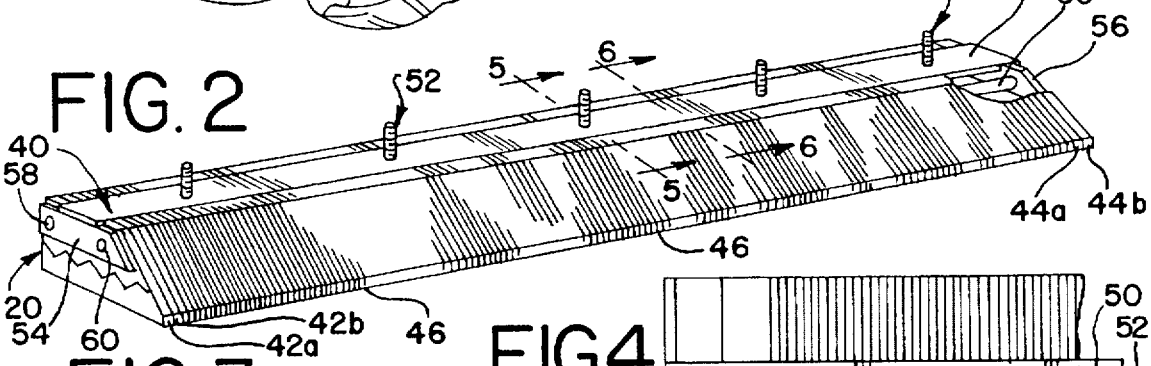
FIG. 2
FIG. 3
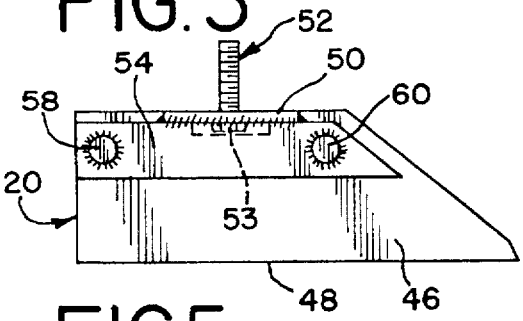
FIG. 4
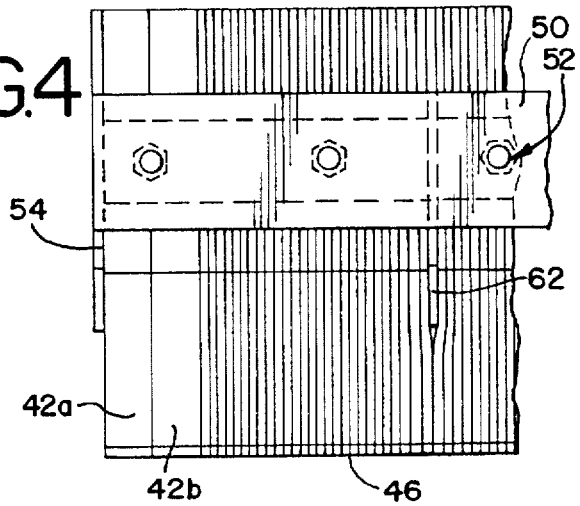
FIG. 5
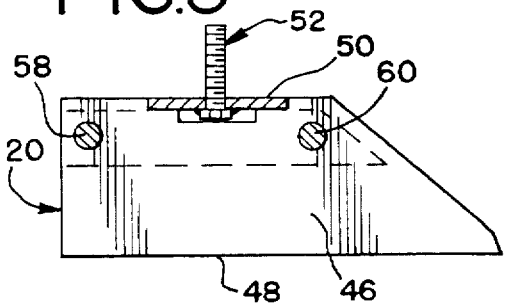
FIG. 6
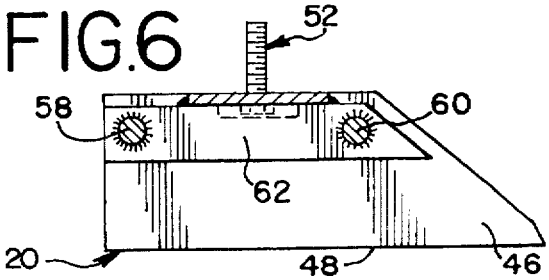

FIG. 13
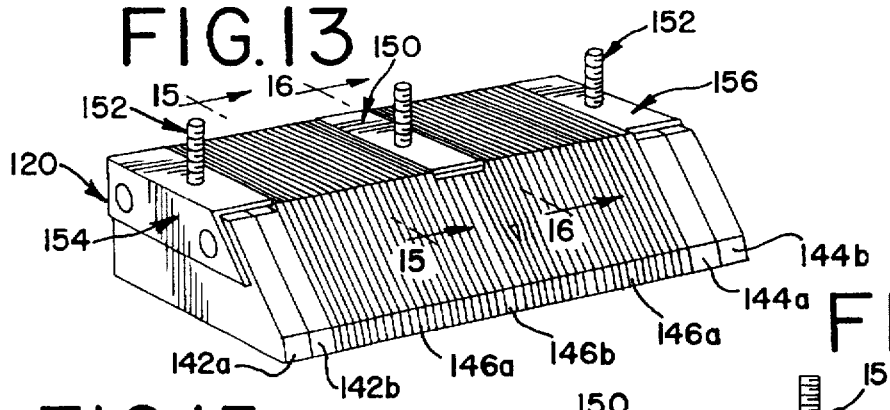
FIG. 16
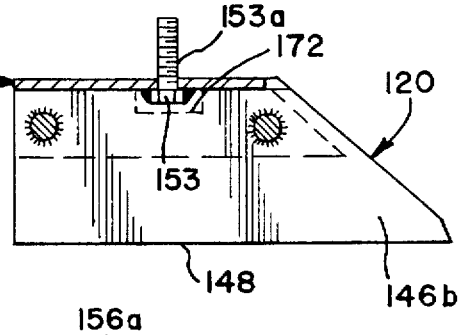
FIG. 15
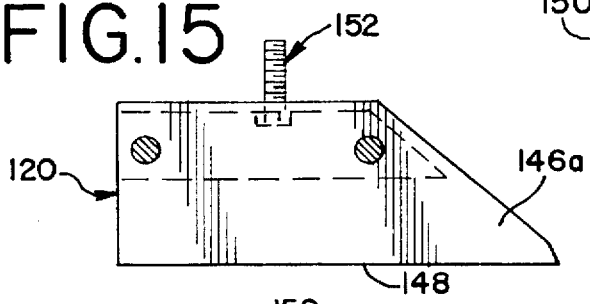
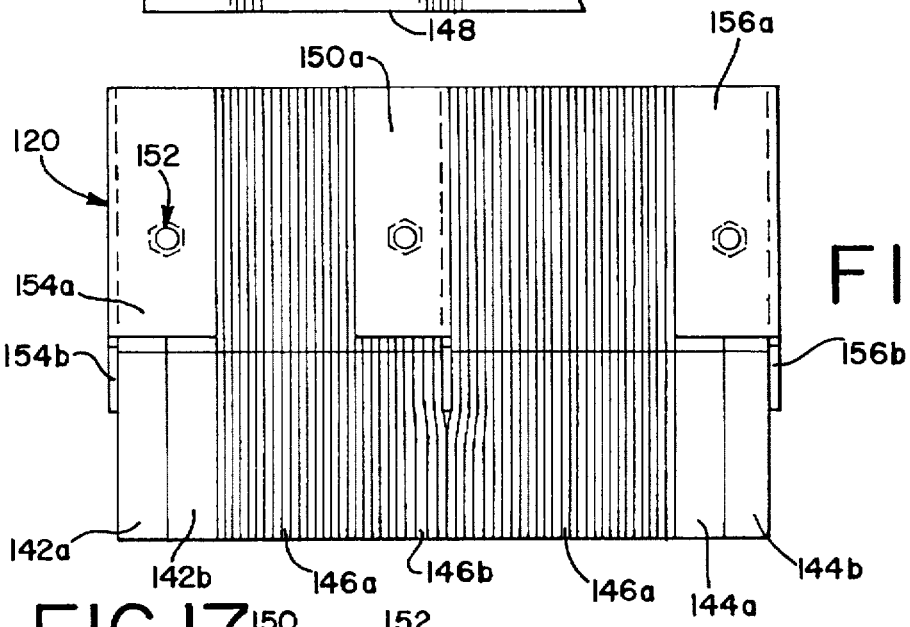
FIG. 14
FIG. 17
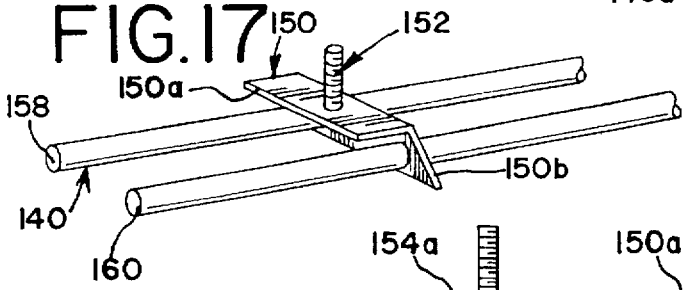
FIG. 18
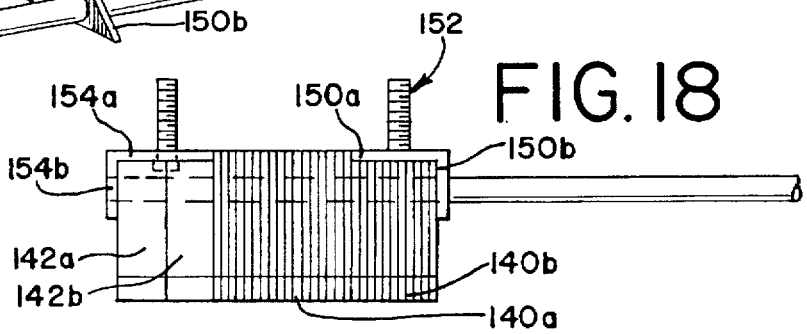

FLOOR AND BUCKET PROTECTION DEVICE

DESCRIPTION

This invention relates in general to a floor and bucket protection device and method of making the device from recycled passenger and light truck steel-belted tires, and more particularly to a protection device which includes a plurality of steel-reinforced rubber pads laminated in a steel frame which is attachable to a bucket on a front end or skid steer loader, wherein the steel reinforcing plies in the rubber pads increase the life span of the pad, prevent tearing and chunking of the pads, and act as individual fingers extending from the bottom edge of the pads to scrape, sweep, and clean the surface which the pads engage.

BACKGROUND OF THE INVENTION

Heretofore, it has been known to provide a wear pad for the buckets on front end loaders or other equipment having bucket assemblies. For example, F&B Enterprises, Inc. of New Bedford, Mass., currently makes and sells a rubberized wear pad made from the sidewalls of recycled fiber-reinforced tires from large trucks and heavy off road equipment. The sidewall sections of those tires are removed from the center tread section, die-cut by a conventional steel rule die or equivalent procedures into eighteen-inch long sections, and laminated together in a steel frame which is bolted to the bucket. The wear pads are made from up to three-inch thick sections of fiber-reinforced rubber material processed from the sidewalls of large truck and heavy off road equipment tires which tend to have a relatively short life span due to the wear of the fiber-reinforced rubber scraping along the floor, ground, or other hard or paved surface. These wear pads are also subject to tearing due to lack of strength of the non-reinforced or fiber-reinforced material and are subject to chunking of the pads due to the lack of strength of the material and the thickness of the individual pads. Accordingly, there is a need for a wear pad which has a greater life span and which does not readily tear or chunk off.

It has also been known to make rubber street pad assemblies to protect pavement surfaces (such as for the bottom of stabilizer arms on back-hoe equipment) and truck dock bumpers from recycled steel-belted tires. It has been further known to make other parts, such as exhaust system hangers, from recycled steel-belted tires using male and female dies.

SUMMARY OF THE INVENTION

The present invention provides a floor and bucket protection device which is attachable to a bucket on a front end loader, a skid steer loader, or other equipment having a bucket or bucket assembly. The floor and bucket protection device of the present invention includes a plurality of relatively thin steel and fiber-reinforced rubber pads laminated between relatively thick fiber-reinforced rubber pads on each end in a steel frame which is attachable to the bucket. The rubber pads are aligned in the frame such that the bottom edges of the pads form a substantially flat wear surface at the bottom of the protection device. The steel reinforcing strands or plies in the thin rubber pads strengthen the rubber pads, prevent tearing and chunking of the rubber pads, and provide significant abrasion resistance, thereby extending the life span of the protection device. After a minimal amount of use or wear, the steel reinforcing plies or bristles extend from the wear surface at the bottom of the protection device and act as individual fingers which scrape, sweep, and clean the floor, road, runway, pavement, concrete, or other hard surface without chipping that surface. In addition to providing these advantages, the floor and bucket protection device provides the advantages of the prior known wear pads such as reducing wear on the floor and thereby increasing the life of the floor, reducing wear on the bucket and thereby increasing the life of the bucket, substantially eliminating bucket scraping noise, and substantially reducing bucket vibration and operator fatigue. Accordingly, the protection device of the present invention is ideal for industrial and municipal applications, agricultural feed lots, waste recycling centers, and snow removal equipment.

The present invention further includes the method of forming the floor and bucket protection device having steel-reinforced pads from recycled passenger and light truck steel-belted tires. More particularly, passenger and light truck steel-belted tires have a center tread section, two sidewalls, and a bead on each sidewall. To form the steel-reinforced rubber pads from the recycled tires, the beads are removed from the sidewalls of the tire, the tires are cut across the center tread section and sidewalls, the sidewalls are then cut or slit off the center tread section, and the outer portion of the pure rubber tread is split from the center tread section of the tire that includes the steel belts. The center tread section is then stamped into steel-reinforced rubber pads of a desired shape and with holes for mounting the pads in aligned relation on a frame. According to the present invention, coacting male and female dies are used to cut the steel-reinforced rubber pads from the center tread section. The steel-reinforced rubber pads are then aligned and laminated between thicker fiber-reinforced pads of the same outer shape on a steel frame to form the floor and bucket protection device of the present invention.

The steel frame of the floor and bucket protection device includes a top plate, a plurality of bucket-attaching bolts, two end plates, a plurality of center plates, and at least two rods. The frame is first constructed with the top plate, one end plate, and the rods assembled together. Following the placement of one or more thicker fiber-reinforced pads on the frame at one end, a series of thinner steel-reinforced pads are placed on the frame over the rods followed by a center plate. A force is applied against the center plate to compress the pads against the end plate and tightly against one another, and the center plate is then welded to the top plate and the rods, thereby maintaining the pads tightly against one another. The process of adding pads and center plates, compressing the pads, and welding the center plates to the rods and top plate is repeated until the frame is substantially full. Then, one or more thicker fiber-reinforced pads are placed on the frame, followed by an end plate opposite the first end plate which is welded to the end of the rods and the top plate.

Alternatively, the floor and bucket protection device of the present invention may be constructed in smaller sections which are individually attached to the bucket. In one alternative embodiment, the frame is constructed from a center structural angle plate, two end structural angle plates, and two rods connecting the center and end structural angle plates, as described below. In another alternative embodiment, the frame is constructed from two end structural angle plates and two rods connecting those plates, as described below.

The steel plies or strands which form the steel belts in the tires strengthen the rubber material and decrease the rapid wear of the rubber material, thereby extending the life span of the pad. The steel-reinforced pads are also significantly thinner than the pads processed from large truck and heavy off road equipment. The thinner pads provide the advantage of a greater ratio of steel and fiber plies to rubber in each pad. This greater ratio of steel and fiber plies to rubber increases strength and wear resistance and significantly decreases the likelihood of tearing and chunking found in the non-reinforced or fiber-reinforced rubber pads.

It is therefore an object of the present invention to provide a floor and bucket protection device with steel-reinforced rubber pads made from recycled tires.

Another object of the present invention is to provide a floor and bucket protection device having steel-reinforced rubber pads which reduce the wear of the rubber and increase the life span of the pads.

A further object of the present invention is to provide a floor and bucket protection device having steel-reinforced rubber pads which prevent tearing and chunking of the pads.

It is a further object of the present invention to provide a floor and bucket protection device having steel-reinforced rubber pads where the steel plies act as individual fingers extending from the wear surface to scrape, sweep, and clean the floor, pavement, or other hard surface which the protection device engages.

A further object of the present invention is to provide a floor and bucket protection device having steel-reinforced rubber pads which reduces wear on the floor and thereby increases the life of the floor, reduces wear on the bucket and thereby increases the life of the bucket, substantially eliminates bucket scraping noise, and substantially reduces bucket vibration and operator fatigue.

A still further object of the present invention is to provide a floor and bucket protection device having steel-reinforced rubber pads that has a substantially large ratio of steel and fiber plies to rubber which prolongs the life of the protection device.

A yet further object of the present invention is to provide a method of forming a floor and bucket protection device having steel-reinforced pads from recycled passenger and light-truck steel-belted tires.

Other objects, features and advantages of the invention will be apparent from the following detailed disclosure, taken in conjunction with the accompanying sheets of drawings, wherein like reference numerals refer to like parts.

DESCRIPTION OF THE DRAWINGS

FIG. 1 is a perspective view of a skid steer loader having the floor and bucket protection device of the present invention attached to the bottom of the bucket;

FIG. 2 is an enlarged perspective view of the protection device;

FIG. 3 is an end view of the protection device;

FIG. 4 is an enlarged fragmentary top view of the protection device;

FIG. 5 is a cross-sectional view of the protection device taken substantially along line 5—5 of FIG. 2 and illustrating the steel-reinforced rubber pad;

FIG. 6 is a cross-sectional view of the protection device taken substantially along line 6—6 of FIG. 2 and illustrating the center plate welded to rods and top plate;

FIG. 13 is an enlarged perspective view of a further embodiment of the floor and bucket protection device of the present invention;

FIG. 14 is a top plan view of the protection device of FIG. 13;

FIG. 15 is a cross-sectional view taken substantially along line 15—15 of FIG. 13 and illustrating the steel-reinforced pad;

FIG. 16 is a cross-sectional view taken substantially along line 16—16 of FIG. 13 and illustrating the center structural angle plate;

FIG. 17 is a perspective view of the steel frame during assembly of the protection device of FIG. 13 and illustrating the center structural angle plate, a bucket-attaching bolt, and the rods; and FIG. 18 is a front elevational view of a partial assembly of the protection device of FIG. 13 with one section of rubber pads and an end structural angle plate of the steel frame.

DESCRIPTION OF THE INVENTION

Figure 7:
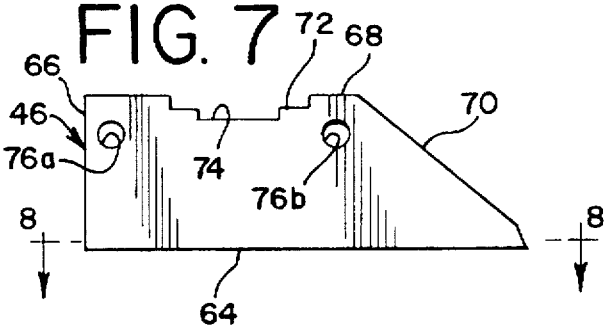
FIG. 7 is a side elevational view of a single steel-reinforced rubber pad.

Referring now to the drawings, and particularly to FIG. 1, the floor and bucket protection device of the present invention, generally indicated by numeral 20, is shown mounted on a front end loader 22. The front end loader 22 includes a main body or vehicle 24 supported by ground engaging wheels 26, lifting arms 28 attached to the main body 24, and a bucket 30 attached to the lifting arms 28. The bucket 30 includes a ground or floor engaging bottom plate 32, opposite side walls 34 and 36, and a back wall 38. The floor and bucket protection device 20 is attached to the bottom plate 32 of the bucket 30. The protection device 20 of the present invention may also be attached to other vehicles or equipment having a bucket and is primarily adapted to engage a floor, road, runway, pavement, concrete, or other such surface.

More specifically, referring now to FIGS. 2 to 6, the floor and bucket protection device 20 of the invention includes a steel frame 40, two pairs of relatively thick fiber-reinforced end pads **42*a* and 42*b* and 44*a* and 44*b* mounted at each end of the frame 40, and a plurality of relatively thin steel-reinforced rubber pads 46 mounted on the frame between the sets of end pads. It should be appreciated that only one of the thicker fiber-reinforced pads may be provided at each end in some assemblies, even though a pair is preferred. The steel-reinforced rubber pads 46 are aligned on the frame 40 such that the bottom edge of the pads forms a substantially flat wear surface 48 at the bottom of the protection device 20, as seen in FIG. 1**, which is adapted to engage the floor. While the size of the protection device may vary depending on the size of the bucket, a standard size protection device will be approximately sixty inches (1.52 m) long.

The steel frame 40 includes a rectangular top plate 50, bucket-attaching bolts 52, end plates 54 and 56, rods 58 and 60, and a plurality of center plates 62. The pads 42*a*, 42*b*, 44*a*, 44*b*, and 46 are somewhat centrally positioned under the top plate 50 which extends across the entire length of the protection device 20. A series of evenly spaced apart threaded bucket-attaching bolts or studs 52 extend through and upwardly from the top plate 50. The bolts 52 include heads 53 that are suitably attached to the bottom surface of the top plate 50 such as by welding. The end plates 54 and 56 are suitably mounted at opposite ends of the top plate 50, and the rods 58 and 60 which receive and hold the pads are mounted in and extend between the end plates. The rods extend parallel to the top plate. The end plates are suitably attached to the top plate and rods, such as by welding. A series of evenly spaced apart vertically disposed center plates 62 are mounted on the rods 58 and 60 and welded to the rods and to the top plate 50 to maintain the pads under compression and tightly against one another and to strengthen the frame. The frame is preferably made from steel; however, it should be appreciated that the frame could be made from other sufficiently strong materials.

The steel-reinforced rubber pads 46, as further illustrated in FIG. 7, are approximately 5/16 to 7/16 inch (7 to 10 mm) thick and are preferably made from the center tread section of passenger and light-truck steel-belted tires, as described below. Each pad 46 has a generally trapezoidal shape including a bottom edge 64, a back edge 66, a top edge 68, and a front edge 70. The length of the bottom edge is greater than the top edge such that the front edge slopes downwardly from the top edge to the bottom edge forming an obtuse angle with the top edge and an acute angle with the bottom edge. The slope of the front edge cooperates with the bottom plate of the bucket to pick up materials along the floor. The top edge 68 has a first rectangular cutout section 72 which is sized to receive the top plate as shown in FIGS. 2 and 5. A second rectangular cutout section 74 is centrally positioned in the first cutout section 72, sized larger than the width of the head 53 of the bolt 52, and is adapted to receive the head of the bolt as shown in FIG. 5. The pad 46 also includes a pair of circular holes or apertures 76*a* and 76*b*, sized to fit on the rods 58 and 60 such that the pads can be mounted and aligned on the rods during assembly.

The fiber-reinforced end pads 42*a*, 42*b*, 44*a*, and 44*b* have the same overall shape and size as the pads 46 including the cutouts and the rod apertures, but are approximately 1-1/8 inches (2.5 to 3.5 cm) thick and are made from the fiber-reinforced center tread sections of truck tires. The preferable truck tire is for rims of twenty or more inches. Before mounting, the end pads are curved from the back edge to the front edge according to the curvature of the truck tire and are mounted on the frame against that curvature to minimize flare-out of the end pads during use. Since the pads will have a tendency to return to their original curvature because of the memory in rubber, they will apply a biasing force against the steel-reinforced pads to assist in maintaining those pads tightly against one another and to prevent the endmost steel-reinforced pads from flaring.

Figure 8:
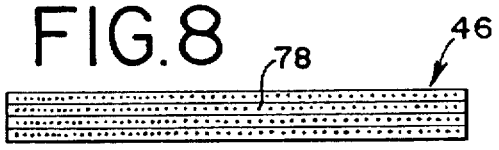
FIG. 8 is a cross-sectional view taken substantially along line 8—8 of FIG. 7 and illustrating a plurality of steel and fiber reinforcing plies in the rubber pad.

Referring now also to FIG. 8, each steel-reinforced pad has one or more layers of steel strands or plies 78, each steel strand being approximately 0.025 inch (0.65 mm) in diameter and embedded in the rubber body of pad 46. The pad may also include fiber strands. The plurality of steel strands or plies may extend from the top edge 68 to the bottom edge 64, from the back edge 66 to the front edge 70, diagonally between the edges or, depending on the tire, in one or more combinations of directions. The steel-reinforcing plies 78 in the rubber pads 46 make the pads significantly stronger than non-reinforced or fiber-reinforced pads. These relatively thin pads provide the significant advantage of a greater ratio of steel and fiber plies to rubber in each pad. This greater ratio of steel and fiber reinforcement to the rubber significantly increases strength and decreases the likelihood of tearing and chunking of the pads. The steel-reinforced pads further reduce the rapid deterioration of the rubber from the wear surface of the pad, thereby increasing the overall life span of the floor and bucket protection device of the present invention. The steel-reinforced pads also provide significant abrasion resistance which extends the life of the protection device.

Passenger and light-truck recycled steel-belted tires generally have a center tread section containing steel and fiber-reinforced rubber layers and a pure rubber tread layer, two sidewalls integrally connected to opposite sides of the center tread section, and a circular bead on each sidewall. To form the pad from the steel belted tire, the tire first undergoes a debeading or cutting operation in which the beads are removed from the sidewalls of the tire as is well known in the industry. The center tread section and the sidewalls of the tire are then cut or slit across the tread (i.e. transverse to the circumference of the tire) by moving the tire over a stationary vertically disposed circular saw. Both sidewalls of the tire are then simultaneously cut off from the center tread section by moving the tire over a pair of spaced-apart stationary vertically disposed circular saws. The center tread section is then placed through a splitting machine which removes the outer portion of the pure rubber tread layer from the center tread section of the tire. In particular, the tire is fed through two horizontally disposed compressing rollers which flatten the curvature of the center tread section and drive the center tread section past a horizontally disposed band saw which removes the pure rubber tread layer. The center tread section consisting of the steel-reinforced and fiber-reinforced rubber layers is then transported to a die-cutting or stamping station. The horizontal band saw blades and circular saw blades are commercially available from Simmons Engineering of Wheeling, Ill.

Fiber-reinforced tires can be cut or stamped with conventional steel rule die-cutting equipment in which the tire section is placed on a flat platform or platen and a cutting die stamps the tire by cutting through the tire to the platen. However, steel-belted tires cannot be stamped with such conventional steel rule die-cutting equipment. Die-cutting equipment having male and female halves must be used to stamp the steel-belted tires. More particularly, the die includes a stationary female section on which the center tread section is placed. A male section coacts with the female section to stamp the steel-belted tire by cutting through the tire. The tire is preferably stamped such that the plies substantially do not extend from any edge of the pad. This increases the safety of the pads for assembly and the overall handling of the protection device.

Figure 9:
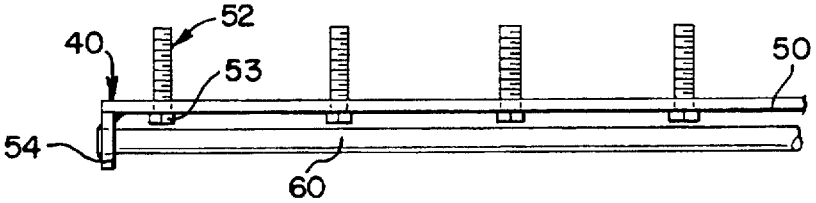
FIG. 9 is a fragmentary front elevational view of the steel frame during assembly of the protection device and illustrating the top plate, the attaching bolts, one end plate, and one rod.
Figure 10:
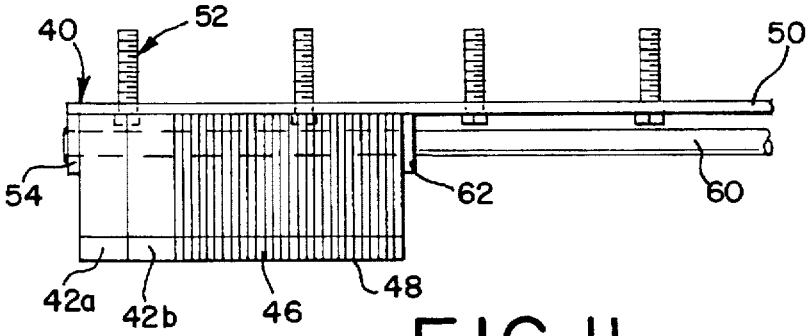
FIG. 10 is a fragmentary front elevational view of a partial assembly of the protection device with one section of rubber pads and a center plate mounted on the steel frame.
Figure 11:
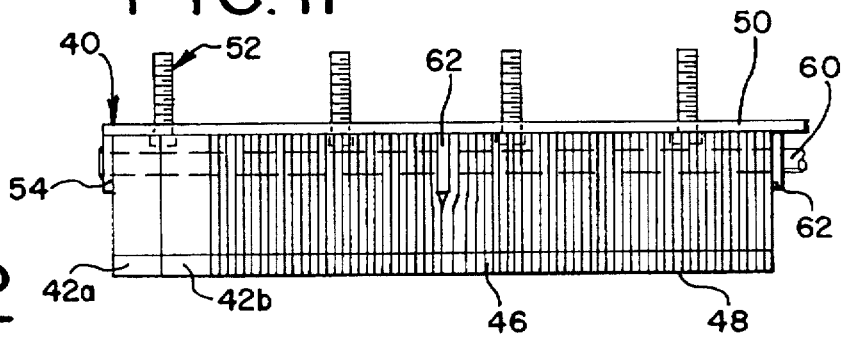
FIG. 11 is a fragmentary front elevational view of a further partial assembly of the protection device with two sections of rubber pads and two center plates mounted on the steel frame.

Referring now to FIGS. 9 to 11, assembly of the floor and bucket protection device is illustrated. The steel frame 40 is partially constructed by inserting the rods into predrilled holes in the end plate 54 and welding the rods to the end plate 54. Prior to welding the top plate 50 to the end plate 54, a series of spaced-apart holes are drilled through the rectangular top plate 50, bolts or studs 52 are inserted in holes, and the heads 53 of the bolts 52 are welded to the bottom surface of the top plate 50. The protection device is assembled on a rubber loading machine. Although not shown, the rubber loading machine includes a horizontally disposed platform, an upstanding stop member at one end of the platform, and a horizontally disposed hydraulic press at the other end of the platform. The hydraulic press has a ram adapted to exert force toward the stop member. The stop member may have a suitable clamp for holding down the frame. The frame is horizontally placed on the rubber loading machine between the stop member and the hydraulic press and with the end plate 54 against the stop member. The fiber-reinforced end pads 42*a* and 42*b* are placed over the open end of the rods and placed against the end plate 54. The end pads 42*a* and 42*b* are placed on the frame with their concave surface (i.e., the inside of the truck tire) toward the inside of the frame and their convex surface (i.e., the outside or tread side of the truck tire) adjacent to the end plate 54. A series of steel-reinforced rubber pads 46 are then placed over the open end of the rods and aligned against the end pads 42*a* and 42*b* with their bottom edges forming the wear surface 48. After placing approximately ten inches of rubber pads on the frame, a center plate 62 is placed over the rods and positioned adjacent to the pads, as seen in FIG. 10. The ram of the hydraulic press is then actuated to compress the center plate 62 against the pads 42 and toward the end plate 54, thereby compressing the rubber pads. The center plate is then welded to the rods and the bottom of the top plate while the pads and center plate are under compression, thereby maintaining the approximately ten inches of pads including pads 42*a* and 42*b* and pads 46 under compression. This compression straightens the end pads 42*a* and 42*b* against their natural curvature and substantially eliminates spaces between the pads, thereby forming a substantially continuous wear surface 48. This arrangement prevents or minimizes the flare-out of the thin pads at the end, which would occur during use due to the pressure on the thin pads, because the original curvature of the thicker end pads constantly produces pressure against the adjacent thinner pads 46 by tending to return to their naturally formed position.

After welding the center plate, the ram is retracted and ten more inches of steel-reinforced pads 46 are placed on the frame. A second center plate 62 is then placed on the frame adjacent those pads, the ram is actuated to compress the center plate 62 against the pads 46, and the center plate is welded to the rods and top plate, as seen in FIG. 11. This process is repeated approximately every ten inches until the frame is substantially full of pads. In the last group of pads, a second pair of fiber-reinforced pads 44*a* and 44*b* are placed on the frame with their concave surface toward the inside of the frame adjacent the pads 46 and their convex surface adjacent the end plate 56 to minimize pad flare-out. The end plate 56 is placed on the frame and the ram compresses the end plate against the pads 46. The end plate is then welded to the rods and the top plate. The ram is then retracted and the frame is removed from the rubber loading machine. If desired, the protection device may be painted after assembly is completed. Also, it should be appreciated that the protection device could be assembled on a vertical rubber loading machine.

The protection device 20 is attached to the bucket by drilling holes in the bottom plate of the bucket corresponding to the bolts on the top plate. The bolts are then inserted through the holes in the bucket, and suitable washers, lockwashers, and nuts are mounted on the bolts to secure the protection device to the bucket. Other suitable or conventional attachments may be used to secure the protection device to the bucket. It will be appreciated that the number and placement of the bolts may vary.

Figure 12:
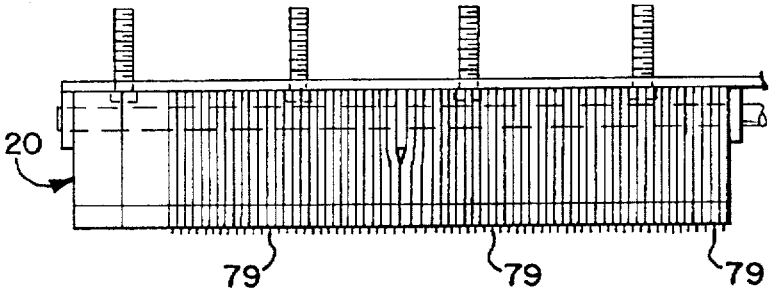
FIG. 12 is a fragmentary front elevational view of the pad after wear and having the steel plies or bristles extending from the bottom of the pad.

As further seen in FIG. 12, after minimal use and/or a few hours of use, depending on the floor surface and pressure placed on the protection device 20, a small amount of rubber material on the bottom edges of the pads forming the wear surface 48 of the device 20 will wear off and expose ends of the steel strands to define a multitude of steel bristles 79. These bristles 79, which extend from the wear surface 48, will engage the floor. The bristles 79 will act as individual fingers extending from the wear surface to scrape, sweep, and clean the floor, road, runway, pavement, concrete, or other hard surface. After further use, the steel bristles 79 will bend or break off and additional rubber will wear off the bottom edges of the pads, thereby exposing further steel bristles 79 extending from the wear surface. During removal and adjustment of the protection device, care will need to be taken to avoid contact with the bristles. The steel bristles extending from the wear surface will generally not come in contact with people during use, thereby providing a relatively safe device.

Referring now to FIGS. 13 to 18, a further embodiment of floor and bucket protection device of the present invention, generally indicated by numeral 120, is illustrated. The protection device is approximately twenty inches (51 cm) in length and is easier to handle than the larger sixty-inch (153 cm) protection device 20. Depending on the size of a bucket, one or more protection devices 120 may be used. The protection device 120 includes a steel frame 140, a pair of relatively thick fiber-reinforced end pads 142*a* and 142*b* at one end, and a pair of thick pads 144*a* and 144*b* mounted at the other end of the frame 140. A plurality of relatively thin steel-reinforced rubber pads 146 are mounted on the frame between the end pads. The steel-reinforced rubber pads 146 are aligned on the frame 140 to form a wear surface 148 at the bottom of the protection device 120 which is adapted to engage the floor.

The steel frame 140 includes a center structural angle plate 150, bucket-attaching bolts or studs 152, two end structural angle plates 154 and 156, and two rods 158 and 160. The center structural angle plate has horizontal and vertical portions 150*a* and 150*b*, and the end structural angle plates have horizontal and vertical portions 154*a* and 154*b* and 156*a* and 156*b*. The bucket-attaching bolts or studs 152 include heads 153 and threaded shanks 153*a* that extend through and upwardly from the horizontal portions 150*a*, 154*a*, and 156*a* of the center and end structural angle plates. The heads 153 of the bolts are suitably attached to the bottom surface of the horizontal portions such as by welding. The rods 158 and 160 are welded to and extend through the vertical portion 150*b* of the center structural angle plate and are welded to the vertical portion of each end structural angle plate. The frame is preferably made from steel; however, it should be appreciated that the frame could be made from other sufficiently strong materials.

There are two differently shaped steel-reinforced pads 146*a* and 146*b* in the embodiment of the protection device, as illustrated in FIGS. 15 and 16. Pad 146*a* has a bottom edge, a back edge, a top edge, and an inclined front edge similar to pad 46; however, pad 146*a* has a height equal to the height of the protection device 120, has no cutouts, and is adapted to be placed on the frame between the horizontal portions of the structural angles. Pad 146*b* has a bottom edge, a back edge, a top edge, and an inclined front edge similar to pad 46, and the height of the pad 146*b* is less than the height of pad 146*a* because the top edge of the pad is under the horizontal portion of the center or end structural angle plates. The top edge of the pad has a rectangular cutout section 172 sized larger than the width of the head of the bolt and is adapted to receive the head of the bolt, as shown in FIG. 16. The pads 146*a* and 146*b* include a pair of circular holes or apertures (not shown) like pad 46 such that the pads can be easily mounted on the rods 158 and 160 during assembly.

The fiber-reinforced end pads 142*a*, 142*b*, 144*a*, and 144*b* have the same overall shape as pad 146*b* including a reduced height, the bolt head cutout, and the rod apertures, and are approximately 1-⅛ inch (2.5 to 3.5 cm) thick and are made from the center tread sections of truck tires. Like pads 42*a*, 42*b*, 44*a*, and 44*b*, pads 142*a*, 142*b*, 144*a*, and 144*b* are formed with the curvature of the truck tire and mounted on the frame against the curvature to minimize flare-out of the thinner pads in the protection device 120.

Referring now to FIGS. 17 and 18, the assembly of the floor and bucket protection device 120 is illustrated. The steel frame 140 is partially constructed by drilling two holes in the vertical portion 150*b* of the center structural angle plate 150, inserting the rods into those holes, centering the plate 15° on the rods, and welding the rods 158 and 160 to the vertical portion 150*b*. A hole is drilled through the horizontal member 150*a* of the center structural angle plate 150, a bolt or stud 152 is inserted in the hole, and the head of the bolt is welded to the bottom surface of the horizontal portion, as shown in FIG. 16. The frame is horizontally placed on a rubber loading machine, as previously described, with the center structural angle plate against the upstanding stop member. A plurality of steel-reinforced rubber pads 146*b* are then placed over the open ends of the rods opposite the stop member and against the center structural angle plate under the horizontal portion. A plurality of steel-reinforced rubber pads 146*a* are then placed over the open ends of the rods against the pads 146*b*. The fiber-reinforced end pads 142*a* and 142*b* are placed over the open end of the rods and pushed against the pads 146*a*. The end pads are placed on the frame with their concave surface facing the center of the device and their convex surface facing the end structural angle plate. After placing these rubber pads 146*b*, 146*a*, 142*a*, and 142*b* on the frame with the bottom edges of the pads forming the wear surface 148, the end structural angle plate 154 is placed on the rods. The rubber loading machine, and specifically the hydraulically actuated ram, engages the end structural angle plate and compresses the pads. The vertical portion 154*b* of the structural end angle is then welded to the rods, thereby maintaining the pads under compression. The entire frame assembly is removed from the rubber loading machine and then flipped around and the process is repeated using pads 146*a*, 144*a*, and 144*b* on the other side of the frame. If desired, the protection device may be painted after assembly is completed.

The protection device 120 is attached to the bucket by drilling holes in the bottom plate of the bucket corresponding to the bolts on the top plate. The bolts are then inserted through the holes in the bucket, and suitable washers, lockwashers, and nuts are mounted on the bolts to secure the protection device to the bucket. Depending on the size of the bucket, several sections may be used. These sections are lighter than the protection device 20, are easier to handle and install, and are less expensive.

It should be appreciated that a shorter ten-inch (25 cm) alternative embodiment of the protection device of substantially the same construction as the twenty-inch (51 cm) device may be constructed. The ten-inch device would eliminate the need for the center structural angle plate and would be constructed with two end structural angle plates.

It will be understood that modifications and variations may be effected without departing from the scope of the novel concepts of the present invention, and it is understood that this application is to be limited only by the scope of the appended claims.

The invention is hereby claimed as follows:

1. In a vehicle having a main body, lifting arms attached to said main body, and a bucket attached to said lifting arms, the improvement being in a floor and bucket protection device attachable to said bucket, said protection device comprising:

a frame;

means for attaching said frame to said bucket; and a plurality of rubber pads having top, bottom, front and back edges mounted and aligned in said frame such that the bottom edges of the pads forms a wear surface, said rubber pads including a plurality of steel strands embedded in said rubber pads for reinforcing said rubber pads, and said plurality of rubber pads being mounted in said frame between thicker non-reinforced or fiber-reinforced rubber end pads, whereby the steel-reinforcing strands strengthen the rubber pads thereby reducing the rate of wear of the pads and prevent tearing and chunking of the pads.

2. The floor and bucket protection device of claim 1, wherein the steel strands extend from said bottom edge of said pads along said wear surface as the rubber pads are worn down and provide a sweeping action along the floor which the wear surface engages.

3. The floor and bucket protection device of claim 1, wherein the steel strands act as individual fingers extending from the wear surface to scrape clean the floor.

4. The floor and bucket protection device of claim 1, wherein the rubber pads are die-cut from recycled steel-belted tires.

5. The floor and bucket protection device of claim 1, wherein there is a significant ratio of steel and fiber strands to rubber in the pads.

6. The floor and bucket protection device of claim 1, wherein the steel-reinforced rubber pads are approximately 5/16 to 7/16 inch thick.

7. The floor and bucket protection device of claim 1, wherein said end pads have a concave surface and a convex surface prior to mounting.

8. The floor and bucket protection device of claim 7, wherein the end pads are mounted on the frame with the concave surface toward the steel-reinforced pads.

9. The floor and bucket protection device of claim 1, wherein said frame includes a top plate, two end plates connected to opposite ends of the top plate, and at least one rod connected to and extending between said end plates.

10. The floor and bucket protection device of claim 1, wherein said frame includes at least two structural angle plates and at least one rod connected to and extending between said structural angle plates.

11. A protection device for a bucket mounted on a bucket operating machine to protect against wear on the bucket and the floor, said device comprising a frame attachable to the bucket, a plurality of tightly compressed together laminations defining along one of the edges thereof a wear surface, all of said laminations being made from the tread portion of recycled tires, the endmost laminations being made from fiber reinforced tires and the laminations intermediate thereof being made from steel-belted tires, the endmost laminations being substantially thicker than said intermediate laminations and having a curvature before assembly defining a concave face adjacent the intermediate laminations that when straightened under compression continually biases against the intermediate laminations, the intermediate laminations including a body of rubber having steel strands embedded therein which upon wear at said wear surface causes the strands to protrude and define a sweeping surface.

* * * * *